US009771232B2

(12) United States Patent
Bomstad et al.

(10) Patent No.: US 9,771,232 B2
(45) Date of Patent: Sep. 26, 2017

(54) SYSTEMS AND METHODS FOR PARENT ROLL TAIL REDUCTION

(71) Applicant: Georgia-Pacific Consumer Products LP, Atlanta, GA (US)

(72) Inventors: Andrew G. Bomstad, Green Bay, WI (US); Thomas J. Daul, Oneida, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 494 days.

(21) Appl. No.: 14/197,793

(22) Filed: Mar. 5, 2014

(65) Prior Publication Data

US 2014/0263806 A1 Sep. 18, 2014

Related U.S. Application Data

(60) Provisional application No. 61/780,011, filed on Mar. 13, 2013.

(51) Int. Cl.
*B65H 18/08* (2006.01)
*B65H 18/22* (2006.01)

(52) U.S. Cl.
CPC ..... *B65H 18/22* (2013.01); *B65H 2404/256* (2013.01); *B65H 2406/122* (2013.01); *B65H 2801/84* (2013.01)

(58) Field of Classification Search
CPC .. B65H 16/103; B65H 16/106; B65H 19/126; B65H 19/1836; B65H 19/1889; B65H 19/1863; B65H 2301/4185; B65H 2301/41361; B65H 2301/41468; B65H 2301/41734; B65H 18/22; B65H 2801/84; B65H 2406/122; B65H 2404/256
USPC ... 242/559, 559.3, 559.4, 554, 554.5, 554.6, 242/551, 594.5, 594.6; 226/7, 91, 97.1
See application file for complete search history.

(56) References Cited

U.S. PATENT DOCUMENTS 3,315,908 A * 4/1967 Wetzler ..... B65H 18/22 19/149
4,429,819 A * 2/1984 Palovaara ..... B65H 20/10 226/196.1
4,695,004 A * 9/1987 Grossmann ..... B65H 19/265 242/526.3
5,681,421 A * 10/1997 Biagiotti ..... B65H 19/29 156/187
5,709,354 A * 1/1998 Blandin ..... B65H 19/12 242/551

(Continued)

FOREIGN PATENT DOCUMENTS

WO WO 2011/076268 6/2011

*Primary Examiner* — William A Rivera
(74) *Attorney, Agent, or Firm* — Laura L. Bozek

(57) ABSTRACT

Described herein are methods and systems for reducing the tail on a parent roll. The system may comprise a web tail extending from a parent roll supported by an unwind stand. The system may further comprise one or more nozzles positioned below the web tail and configured to facilitate the rewinding of the web tail about the parent roll. The web tail may be rewound about the parent roll in a direction opposite to that which the web was initially wound about the parent roll. As a result, the length of the web tail extending from the parent roll may be reduced and is less likely to lengthen as the parent roll is ejected from the unwind stand.

8 Claims, 11 Drawing Sheets

(56) References Cited

U.S. PATENT DOCUMENTS

| | | | | |
|---|---|---|---|---|
| 6,607,157 | B1 * | 8/2003 | Duescher | B65H 20/34 242/417.3 |
| 6,719,240 | B2 | 4/2004 | Hanson et al. | |
| 6,722,606 | B2 * | 4/2004 | Hanson | B65H 16/103 242/554.6 |
| RE39,601 | E | 5/2007 | Svanqvist et al. | |
| 8,177,940 | B2 | 5/2012 | Kramer et al. | |
| 8,192,582 | B2 | 6/2012 | Chamberland et al. | |
| 8,216,412 | B2 * | 7/2012 | Gambini | B65H 19/29 118/243 |

* cited by examiner

SYSTEMS AND METHODS FOR PARENT ROLL TAIL REDUCTION

CROSS REFERENCE TO RELATED APPLICATION

This application is based on U.S. Provisional Patent Application No. 61/780,011, filed Mar. 13, 2013, which is incorporated herein by reference in its entirety.

FIELD OF DISCLOSURE

The present disclosure relates to paper manufacturing processes. In particular, the present disclosure relates to methods and systems for reducing paper tails extending from parent rolls.

BACKGROUND

During the paper manufacturing process, as the paper web comes out of the drying section of the paper machine, the paper web is typically wound into a large roll. The winding process typically involves continuously and repeatedly turning the paper web about a central shaft as the web comes out of the drying section of the paper machine. Once complete, these large rolls are commonly called "parent rolls." The process of initially winding paper into parent rolls allows the manufacturer to quickly and efficiently package large quantities of paper as it is produced by the paper machine.

Even so, paper manufactures do not always sell the parent rolls to their customers. Sometimes the manufacturers' customers wish to purchase smaller rolls of paper or other finished products such as paper towels and tissue paper. In such instances, the paper manufacturer uses downstream equipment to create the smaller rolls or to otherwise process the paper into these smaller products.

An important aspect of processing these parent rolls is changing from an old, spent parent roll, to a new full parent roll with as little down time as possible and preferably without stopping the downstream processing equipment. Therefore, the flying splice was developed. In a flying splice system, two or more unwind stands feed a web into the downstream processing equipment. The unwind stands each unwind a web into a splicing area and then to the downstream equipment. A first unwind stand may unroll its parent roll while the other is loaded with a full roll. When the parent roll on the first unwind stand is exhausted or nearly spent, the second unwind stand may start to unwind a second parent roll into the splice area. Once the second parent roll is being unwound, the first parent roll may be replaced by another full roll so that it is ready to be unwound when the second roll is nearly spent.

In paper products in general, and tissue products in particular, each side of the web may have different properties and manufacturers may want to maintain the orientation of these different sides of the web when switching between parent rolls. To maintain the orientation of the paper web between rolls, one unwind stand may have to unwind the web from the bottom of the parent roll, while the another unwind stand may have to unwind the web from the top of the parent roll. For example, in FIG. 1 a parent roll may be unwound from the bottom to cause Side A of its web tail to be on the right and Side B to be on the left as the web tail enters the splicing area, whereas another parent roll may be unwound from the top to cause Side A of its web tail to be on the right and Side B to be on the left as the web tail enters the splicing area.

As a result, the manufacturer unwinds the large parent rolls so that the paper can be rewound into smaller rolls or otherwise processed by other, downstream, equipment. The unwinding of the parent roll generally occurs in an unwind stand and is essentially accomplished by rotating the parent roll in a direction opposite to that used to initially wind the paper web onto the shaft of the parent roll.

Once a portion of a first parent roll, which is unwound from the bottom, is unwound and a second parent roll is unwinding and feeding the downstream equipment the paper web of the first parent roll may be cut. Typically, the paper web is cut across its width, in a cross-machine direction. When the cut is made, a tail is created on the parent roll. The tail consists of the unwound paper web located between the parent roll and the location of the cut. The tail may then be rewound onto the parent roll and the parent roll may be ejected from the unwind stand.

During the ejection process, however, the parent roll may sometimes roll in a direction that causes the tail to unwind from the parent roll and trail on the ground, particularly when the parent roll was unwound from the bottom. When this happens, it is not unusual for fifty feet or more of tail to accumulate on the ground. The unwound portion of the tail may then be rewound onto the parent roll or cutoff, picked up, and discarded. Both of these processes take time and manpower, and cause delays in the unwind process.

Accordingly, current parent roll rewinding and ejection processes could benefit from improved techniques and devices that greatly reduce or eliminate the waste and inefficiencies associated with paper tails created during the unwind and ejection process.

SUMMARY OF THE DISCLOSURE

In accordance with certain embodiments of the present disclosure, various methods, devices, and systems for rewinding and/or reducing the length of a parent roll tail are described. According to one aspect, a system for reducing the length of a paper tail is described. In one aspect, the system comprises an unwind stand, including at least one belt for supporting a parent roll, a splicing area, and at least one nozzle. In one aspect, the at least one nozzle may be configured to expel a gas or fluid in order to facilitate the rewinding of a paper tail onto the parent roll after a portion of paper web has been unwound from the parent roll and spliced. In another aspect, the at least one nozzle may be configured to aid in rewinding the paper tail onto the parent roll in such a manner that the tail does not substantially unwind from the parent roll when the parent roll is ejected from the unwind stand. In a further aspect, the at least one nozzle may be configured to operate in cooperation with the unwind stand in order to aid in rewinding the paper tail onto the parent roll.

According to another aspect, a method for reducing the length of a parent roll tail is described. In one aspect, the method may include folding a portion of a paper tail extending from a parent roll. In another aspect, the folded portion of the tail may be wound around the parent roll in such a manner as to capture the folded tail in a nip between the parent roll and the remainder of the paper tail. In a further aspect, the tail may be rewound onto the parent roll in such a manner that the tail does not substantially unwind from the parent roll when the parent roll is ejected from the unwind stand.

In an additional aspect, the described methods, devices, and systems may facilitate a decrease in the amount of time necessary to perform parent roll changes at an unwind stand.

In a further aspect, the described methods, devices, and systems may reduce the amount of material wasted during the process of unwinding a paper web from a parent roll.

Additional objects and advantages of the described methods, devices, and systems will be set forth in part in the description which follows, and in part will be obvious from the description, or may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments and together with the description, serve to explain the principles of the disclosure.

DESCRIPTION OF EXEMPLARY EMBODIMENTS

Disclosed herein are various exemplary methods and exemplary systems for reducing the length of a parent roll tail. Generally, the exemplary methods may include folding a portion of the tail extending from the parent roll, winding the folded portion of the tail about the parent roll in a direction opposite to that which the paper web was initially wound on the parent roll, and capturing the folded portion of the tail in a nip between the parent roll and the remainder of the paper tail. In one aspect, by rewinding the tail in a direction opposite to that which the paper web was initially wound on the parent roll, the rolling action of the parent roll may prevent the tail from unwinding as the parent roll is ejected from an unwind stand.

Reference will now be made in detail to certain exemplary embodiments, examples of which are illustrated in the accompanying drawings. Wherever possible, the same reference numbers will be used throughout the drawings to refer to the same or like items.

Figure 1:
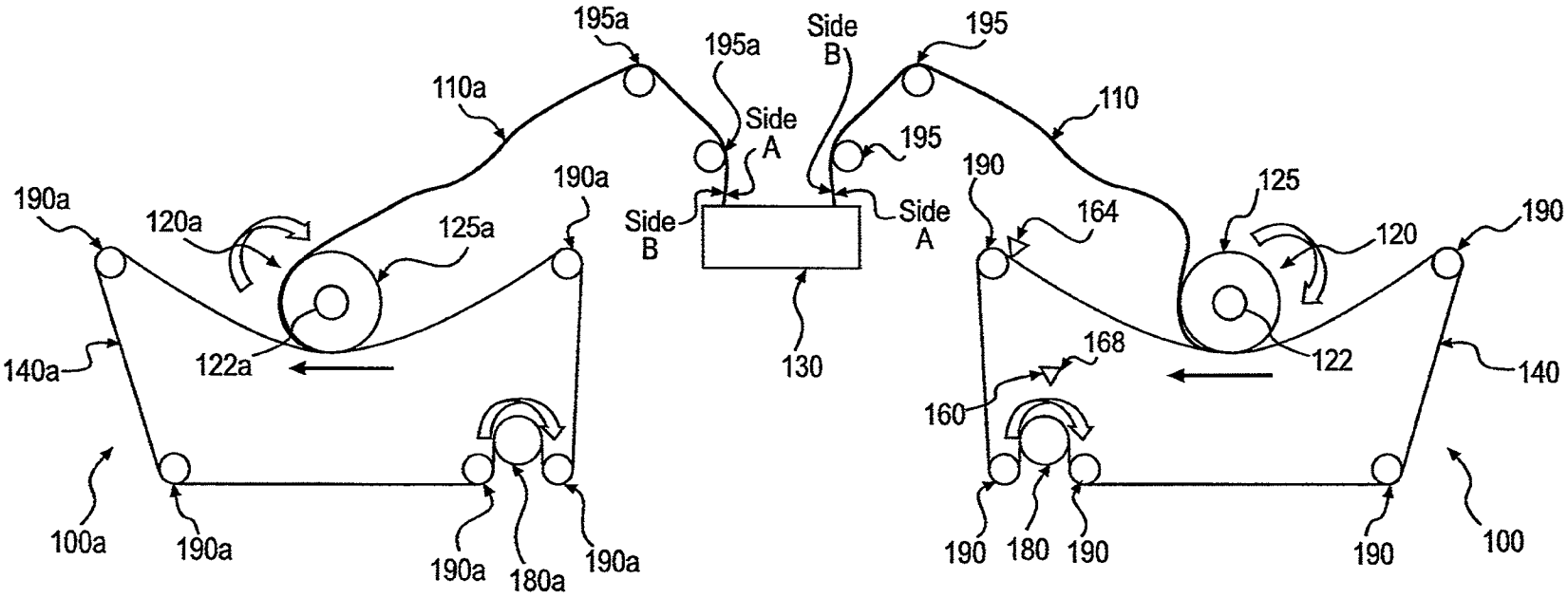
FIG. 1 is a side view of an exemplary embodiment of two unwind stands as disclosed herein.

FIG. 1 depicts one embodiment of unwind stands 100 and 100*a*. In one aspect, unwind stand 100 comprises a drive system 180/180*a*, one or more rollers 190/190*a*, and one or more belts 140/140*a*. In another aspect, unwind stand 100/100*a* comprises a parent roll 120/120*a* and a shaft 122/122*a*. The drive system 180/180*a* may be in communication with the belts 140/140*a* which may be in communication with the rollers 190/190*a*. The drive system 180/180*a* may cause the belts 140/140*a* to move around the rollers 190/190*a*. The parent roll 120/120*a* may be in communication with the belts 140/140*a*, the movement of which may cause the parent roll 120/120*a* to move or rotate. The parent roll 120/120*a* may be composed of a web 125/125*a*. The movement or rotation of the parent roll 120/120*a* may cause the web 125/125*a* to wind around or unwind from the parent roll 120/120*a*. For example, in one embodiment, where drive system 180/180*a* rotates in a clockwise direction (as depicted in unwind stand 100 of FIG. 1), belts 140/140*a* may rotate in a counter-clockwise direction. The counter-clockwise rotation of belts 140/140*a* may, in turn, impart a clockwise rotation to parent roll 120/120*a*. The clockwise rotation of parent roll 120/120*a* may result in the unwinding of web 125/125*a* from the bottom of parent roll 120/120*a*. In other embodiments, drive system 180/180*a* may rotate in a counter-clockwise direction, ultimately resulting in parent roll 120/120*a* rotating in a counter-clockwise direction.

Figure 11B:
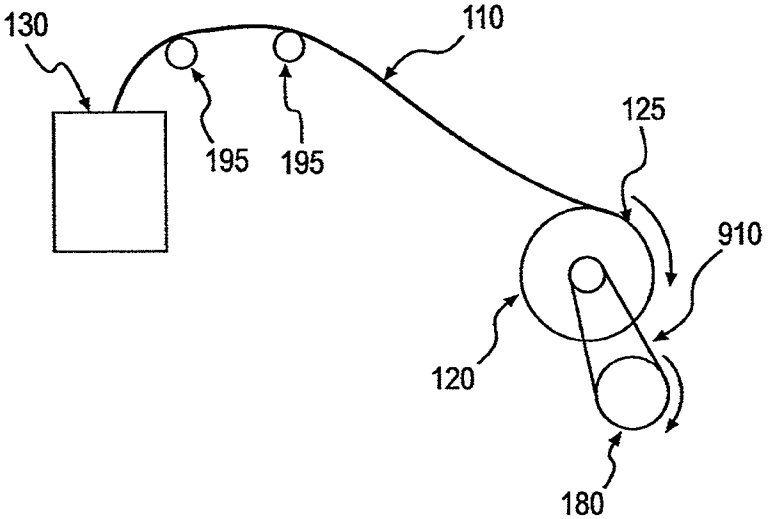
FIGS. 11A-B are side views of exemplary embodiments of an unwind stand as disclosed herein.

In another aspect of the invention, the drive system 180 may impart a force onto the belts 140 that causes the belts 140 to move in one direction or another. In this way, the drive system 180 may also act to control the velocity of the belts 140. The drive system 180 may be powered by an electric motor, turbine, or any other device that facilitates the movement of the belts 140. In another embodiment, the drive system 180 may be coupled to the shaft 122 of the parent roll 120. The drive may be coupled to the shaft 122 either directly or through an intervening device such as a belt or chain 910 as shown in FIG. 11B. In another embodiment, any drive system arrangement that facilitates the unwinding and/or reduction of the parent roll tail 110 may be used. The operation of the drive system 180 may be controlled by a controller such as, for example, the system 400 depicted in FIG. 2.

The rollers 190 may help support and/or guide the belt 140. The embodiment drive stand 100 in FIG. 1 depicts five rollers. In one embodiment four rollers 190 may be used. In still other embodiments, any number of rollers 190 that facilitate the unwinding of the parent roll 120 or reduction of the parent roll tail 110 may be used. In another aspect, rollers 190 can comprise a hollow tube having a length that may be substantially similar to the width of the belts 140. In other embodiments, rollers 190 may be smaller or larger in width than the belts 140. Additionally, rollers 190 may be between about 3 feet and about 30 feet long. In other embodiments, rollers 190 may be shorter or longer. In some embodiments, rollers 190 may be between about 0.5 inches and about 12 inches in diameter. In other embodiments, rollers 190 may be between 3 inches and 9 inches. In still other embodiments, rollers 190 may be smaller or larger in diameter.

In another aspect, rollers 190 may be composed of a metal, such as steel or aluminum. In other embodiments, rollers 190 may be composed of a polymer, such as PVC or HDPE. In still other embodiments, rollers 190 may be composed of multiple components and/or materials such as, for example, a polymer sleeve or coating around a metal body.

Figure 11A:
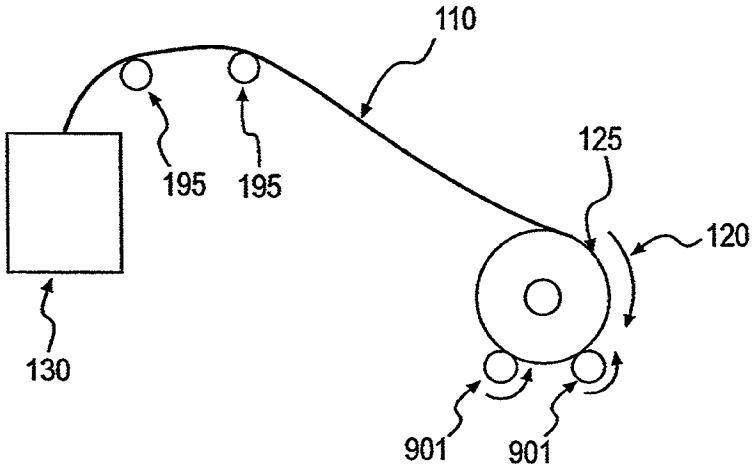

In some embodiments, the belts 140 may be made of a laminated polymer belt or felt. In other embodiments, the belts 140 may be made of a polymer, such as a plastic, or an elastomeric, such as rubber. In other embodiments, the belts 140 may be made of any material or combination or materials that facilitate the movement or rotation of the parent roll 120. In still other embodiments, as shown, for example, in FIG. 11A, rather than belts, shafts or rollers 901 connected either directly or indirectly to a drive system 180 (not shown) may be used to support and/or move or rotate the parent roll 120.

Although the embodiment depicted in FIG. 1 is described as having a plurality of belts, in other embodiments only one belt may be used. In embodiments with only one belt, belt 140 may be substantially the same width, or slightly wider than, the parent roll 120. In other embodiments, belt 140 may be smaller or larger in width than the parent roll.

In embodiments comprising more than one belt 140, unwind stand 100 may comprise two to five belts. In still other embodiments, any number of belts may be used. In one aspect, particularly, but not necessarily, where unwind stand 100 comprises more than one belt 140, each belt 140 may be between about 10 percent and about 95 percent of the width of the parent roll 120. Additionally, the width of belts 140 may be less than 10 percent or greater than 95 percent of the width of the parent roll 120. Further, in some embodiments, each of belts 140 are substantially similar to one another. In other embodiments, one or more of belts 140 may exhibit a different size from other belts or be comprised of a different material from the other belts.

In another aspect, approximately 5 percent to 15 percent of the lateral surface area of parent roll 120 may be in contact with the belts 140. In other embodiments, 15 percent to 25 percent of the lateral surface area of parent roll 120 may be in contact with the belts 140. In still other embodiments, between 1 percent and 5 percent of the lateral surface area of parent roll 120 may be in contact with the belts 140. In alternative embodiments, more than 25 percent of the lateral surface area of parent roll 120 may be in contact with the belts 140.

In one aspect, unwind stand 100 can be loaded with a parent roll 120. In one embodiment, parent roll 120 can comprise a paper web 125 wound around a central shaft 122. In other embodiments, rather than paper, web 125 may be composed of a polymer film or metal sheet. In still other embodiments, web 125 may be composed of any material that may be wound about itself or a central shaft 122. In another aspect, web 125 may be cylindrical in shape. In some embodiments, parent roll 120 may be between about 6 inches (0.5 feet) and about 144 inches (12 feet) in diameter. Additionally, web 125 may be between about 3 feet and about 30 feet wide. In other embodiments, parent roll 120 may be smaller or larger in diameter. In other embodiments, web 125 may be shorter or longer in width. In another aspect, parent roll 120 may weigh between about 100 pounds and about 30,000 pounds. In other embodiments, parent roll 120 may weigh less than about 100 pounds or may weigh more than about 30,000 pounds.

In another aspect, shaft 122 can comprise a hollow tube having a length that may be substantially similar to the width of the parent roll 120 and/or web 125. Additionally, shaft 122 may be between about 3 feet and about 30 feet long. In other embodiments, shaft 122 may be shorter or longer. In some embodiments, shaft 122 may be between about 1 inch and about 18 inches in diameter. In other embodiments, shaft 122 may exhibit a smaller or larger diameter. Shaft 122 may be composed of a metal, such as steel or aluminum. In other embodiments, shaft 122 may be composed of paper products, such as cardboard, or a polymer, such as PVC or HDPE. In still other embodiments, shaft 122 may be composed of multiple components and/or materials such as a hollow cardboard tube around a steel insert. In some embodiments, the shaft 122 may be mounted to the unwind stand 100 via the ends of shaft 122. In other embodiments, shaft 122 may be completely supported by the belts. In alternative embodiments, shaft 122 may not be present. In some embodiments, web 125 may be wound upon itself around a rotational axis, wound around a central cavity, or around a core. In other embodiments, shaft 122 may be stubs that connect to the parent roll 120 or a core of the parent roll.

As discussed above, in an aspect of the invention, the movement of the drive system 180 and/or belt 140 may cause the parent roll 120 to move or rotate. The movement or rotation of the parent roll 120 may cause the web 125 to wind around or unwind from the parent roll 120. Typically, during processing, the movement or rotation of the parent roll 120 causes the web 125 to unwind from the parent roll 120 and move, via one or more tail rollers 195, through a splice area 130. The portion of web 125 that is unwound from the parent roll 120 may be called a web tail 110.

The web tail 110 may be of the same or similar material as the web 125. The web tail 110 may extend from the parent roll 120, through the splicing area 130, and then on to downstream equipment (not shown). The web tail 110 may be supported by tail rollers 195.

The embodiment of unwind stand 100 in FIG. 1 depicts two tail rollers 195 supporting the web tail 110. In other embodiments one or three rollers 195 may be used to support the web tail 110. In still other embodiments any number of tail rollers 195 that facilitate the web tail 110 extending from the parent roll 120 may be used. In another embodiment, tail rollers 195 may be the same or similar to rollers 190. In another aspect, tail rollers 195 can comprise a hollow tube having a length that is substantially similar to the width of the tail 110. In other embodiments, tail rollers 195 may be smaller or larger in width than the tail 110. Additionally, tail rollers 195 may be between about 3 feet and about 30 feet long. In other embodiments, tail rollers 195 may be shorter or longer. In some embodiments, tail rollers 195 may be between about 0.5 inches and about 12 inches in diameter. In other embodiments, tail rollers 195 may be smaller or larger in diameter. Tail rollers 195 may be composed of a metal, such as steel or aluminum. In other embodiments, tail rollers 195 may be composed of a polymer, such as PVC or HDPE. In still other embodiments, tail rollers 195 may be composed of multiple components and/or materials such as, for example, a polymer sleeve or coating around a metal body.

Although FIG. 1 depicts tail rollers 195 supporting the web tail 110, in other embodiments, a non-rotating cylinder or cylinders may support the web tail 110. In still other embodiments, the web tail 110 may be supported by a surface that extends between a portion of the area between the parent roll 120 and the splice area 130. Alternatively, the web tail 110 may be supported by a moving belt that may operate in a manner similar to belt 140.

In another aspect, the splice area 130 may be an area comprising equipment for cutting web tails 110 and 110*a* and for splicing the tails 110 and 110*a* together. The splice area 130 and its associated equipment may cut the web 125 using a cutting blade such as, for example, a knife's edge, cutting roller, or scissors. In still other embodiments, web 125 may be cut using any other instrument known in the art. Further, cutting of the web 125 in the splice area 130 may be performed manually or by automated control.

FIG. 1 depicts the splice area 130 as a defined area, but in other embodiments the splice area 130 may not be defined, per se, but may be located at any location or locations where the web tails 110 are cut or spliced together. In other embodiments, splice area 130 may be configured to move. For example, splice area 130 may be in a location away from web tail 110 during the unwind process and may move to another location during the splicing process. The movement of splice area 130 may be manually operated or may be operated by a controller such as system 400 of FIG. 2.

Figure 9:
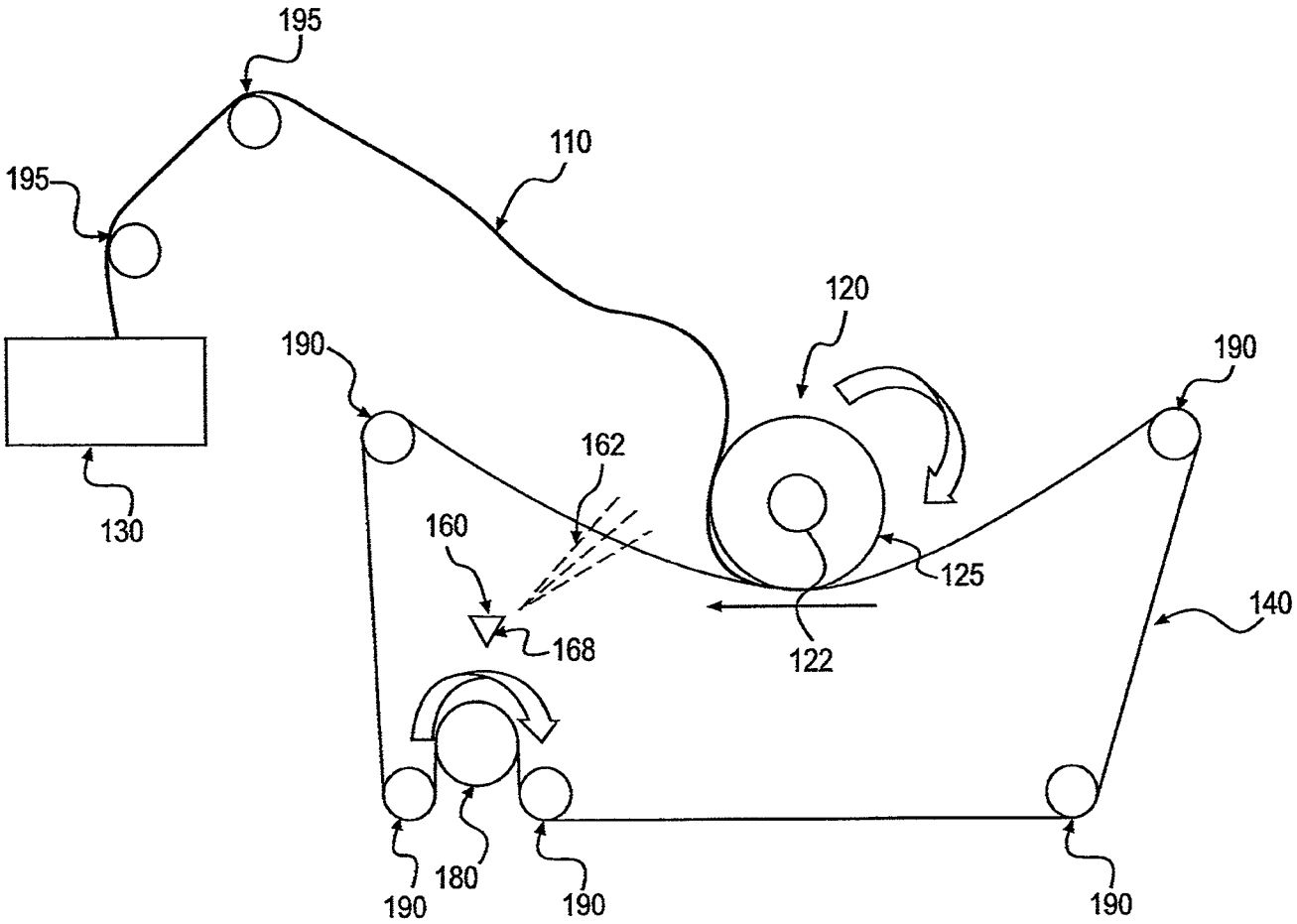
FIG. 9 is a side view of an exemplary embodiment of an unwind stand as disclosed herein.

In one aspect, nozzles 160 and 164 are configured such that they facilitate the rewinding of the web tail 110. In an exemplary embodiment, such as that shown in FIG. 1, two nozzles 160 and 164 are used to facilitate the rewinding of the web tail 110. In other embodiments a single nozzle 160 may be used, such as, for example, the embodiment depicted in FIG. 9 with a single nozzle 160. And in still other embodiments, three or more nozzles 160 may be used.

The nozzle 160 or nozzles 160 and 164 may each expel a fluid or gas stream, such as, for example stream 162 (see FIG. 3), that may impact the web tail 110 and facilitate the rewinding of the web tail 110. The stream 162 and nozzles 160 and 164 may be controlled by valve, such as a solenoid valve, in communication with a controller such as, for example, the system 400 depicted in FIG. 2. Specifically, the velocity, direction, and/or volume of stream 162 ejected from nozzles 160 and 164 may be controlled.

In one embodiment, streams 162 and 166 (FIGS. 3, 4) may be streams of air or gas. In other embodiments streams 162 and 166 may be streams of liquid. In some embodiments the streams 162 and 166 may be streams of a tack adhesive or water that facilitates bonding portion of a web 125 or tail 110 to another portion of web 125 or tail 110. In still other embodiments, streams 162 and 166 may be of any substance that facilitates the reduction of the length of the web tail 110.

Nozzles 160 and 164 may be configured to move to different locations and/or point in different directions. The nozzles 160 and 164 may move or point in different directions by, for example, being attached to one or more linear actuators. In some embodiments, the nozzles 160 and 164 may move or point in different directions by, for example, being attached to one or more rotary actuators. In other embodiments, the nozzles 160 and 164 may move or point in different directions by, for example, being attached to a combination of linear and rotary actuators. In still other embodiments, the nozzles may move or point in different directions by, for example, being attached to an articulated robot or a so-called robotic arm with one or more degrees of freedom. In yet another embodiment, the nozzles may be pivotably mounted to a frame such that they move or point in different directions. The frame itself may be fixed or movable. The movement and direction of the nozzles may be controlled by a controller such as, for example, the system 400 depicted in FIG. 2. In other embodiments, one or more of nozzles 160 and 164 may be fixed in space and/or orientation. The nozzles 160 and 164 may be arranged individually or they may be arranged as groups, such as, for example, in one or more linear or two- or three-dimension arrays. In other embodiments, the array or arrays may be stationary while in other embodiments, the array or arrays may change location or orientation. In still other embodiments, one or more individual nozzles of an array may move independently of the other nozzles in the array.

Each nozzle 160 may have a single orifice 168 or multiple orifices 168. The orifice 168 may be substantially round in shape or they may be square or rectangular. In other embodiments, the orifices 168 may be shaped in any manner that facilitates the rewinding of the web tail 110. In still other embodiments with multiple orifices, the shapes of orifices 168 may differ between nozzles 160 or from orifice to orifice. The orifices 168 may also change size or shape to facilitate the rewinding of the web tail 110, such as, for example, using an adjustable aperture. In some embodiments, adjustment of the aperture may be controlled by a controller such as, for example, the system 400 depicted in FIG. 2.

In another aspect, the unwind stand 100 and its components, including, but not limited to, the drive system 180, the nozzles 160 and 164, the streams 162 and 166 (see FIG. 4), the splice area 130, and the parent roll 120, may be coupled to and/or controlled by any type of processor-based system on which processes and methods consistent with the disclosed embodiments may be implemented.

Figure 2:
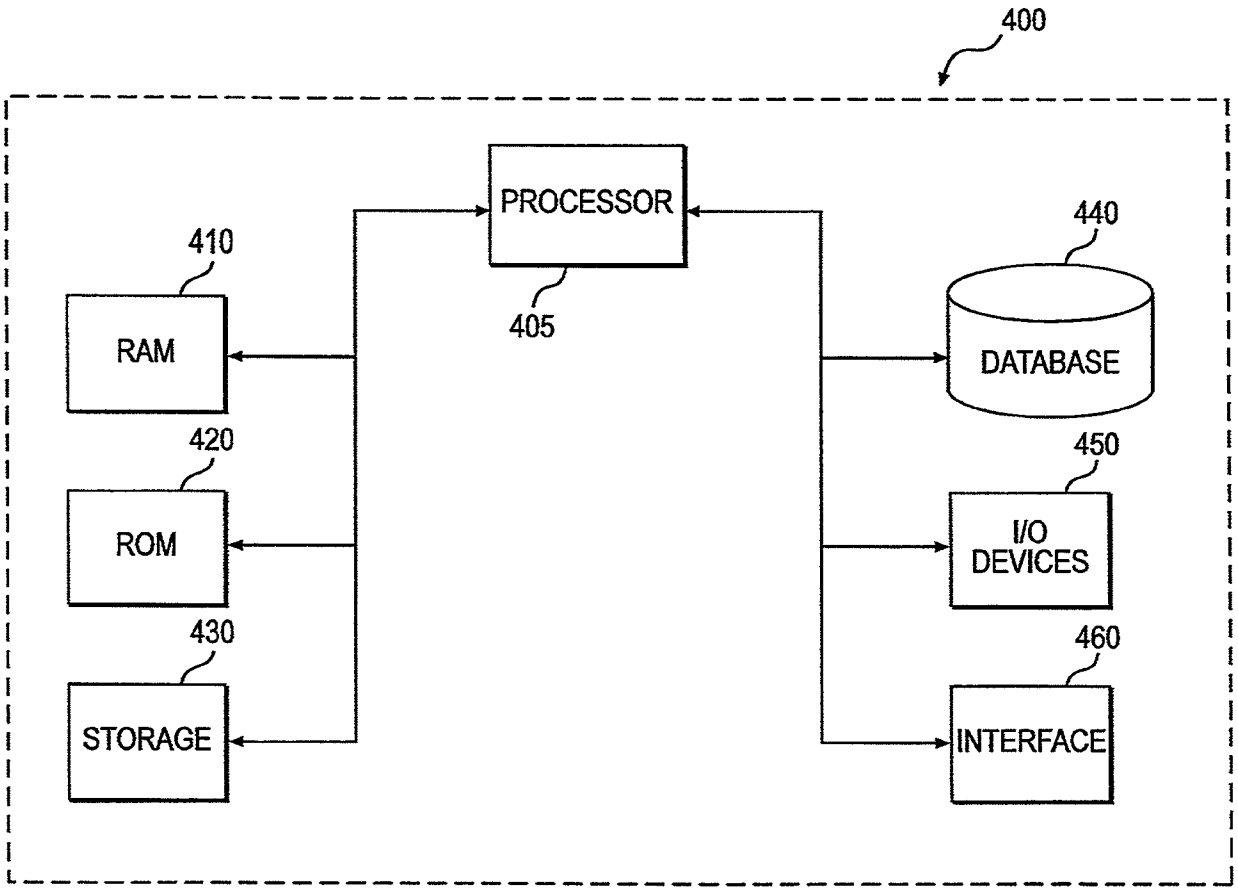
FIG. 2 is an exemplary embodiment of a computer as disclosed herein.

For example, as illustrated in FIG. 2, a system 400 may include one or more hardware and/or software components configured to execute software programs, such as software for storing, processing, and analyzing data. For example, system 400 may include one or more hardware components such as, for example, a processor 405, a random access memory (RAM) module 410, a read-only memory (ROM) module 420, a storage system 430, a database 440, one or more input/output (I/O) devices 450, and an interface 460. Alternatively and/or additionally, system 400 may include one or more software components such as, for example, a computer-readable medium including computer-executable instructions for performing methods consistent with disclosed embodiments. It is contemplated that one or more of the hardware components listed above may be implemented using software. For example, storage 430 may include a software partition associated with one or more other hardware components of system 400. System 400 may include additional, fewer, and/or different components than those listed above. It is understood that the components listed above are exemplary only and not intended to be limiting.

Processor 405 may include one or more processors, which may be configured to execute instructions and process data to perform one or more functions associated with system 400. As illustrated in FIG. 2, processor 405 may be communicatively coupled to RAM 410, ROM 420, storage 430, database 440, I/O devices 450, and interface 460. Processor 405 may be configured to execute sequences of computer program instructions to perform various processes, which will be described in more detail below. The computer program instructions may be loaded into RAM 410 for execution by processor 405.

RAM 410 and ROM 420 may each include one or more devices for storing information associated with an operation of system 400 and/or processor 405. For example, ROM 420 may include a memory device configured to access and store information associated with system 400, including information for identifying, initializing, and/or monitoring the operation of one or more components and subsystems of system 400. RAM 410 may include a memory device for storing data associated with one or more operations of processor 405. For example, ROM 420 may load instructions into RAM 410 for execution by processor 405.

Storage 430 may include any type of mass storage device configured to store information that processor 405 may use to perform processes consistent with the disclosed embodiments. For example, storage 430 may include one or more magnetic and/or optical disk devices, such as hard drives, CD-ROMs, DVD-ROMs, or any other type of mass media device.

Database 440 may include one or more software and/or hardware components that cooperate to store, organize, sort, filter, and/or arrange data used by system 400 and/or processor 405. For example, database 440 may include nozzle locations and/or operating parameters. Alternatively, database 440 may store additional and/or different information.

I/O devices 450 may include one or more components configured to communicate information with a user associated with system 400. For example, I/O devices 450 may include a console with an integrated keyboard and mouse to allow a user to input parameters associated with system 400. I/O devices 450 may also include a display including a graphical user interface (GUI) for outputting information on a monitor. I/O devices 450 may also include peripheral devices such as, for example, a printer for printing information associated with system 400, a user-accessible disk drive (e.g., a USB port, a floppy, CD-ROM, or DVD-ROM drive, etc.) to allow a user to input data stored on a portable media device, a microphone, a speaker system, or any other suitable type of interface device. I/O devices 450 may also include measuring instruments such as, for example, instruments capable of measuring speed, position, weight, and distance.

Interface 460 may include one or more components configured to transmit and receive data via a communication network, such as the Internet, a local area network, a workstation peer-to-peer network, a direct link network, a wireless network, and/or any other suitable communication platform. For example, interface 460 may include one or more modulators, demodulators, multiplexers, demultiplexers, network communication devices, wireless devices, antennas, modems, and any other type of device configured to enable data communication via a communication network.

Figure 3:
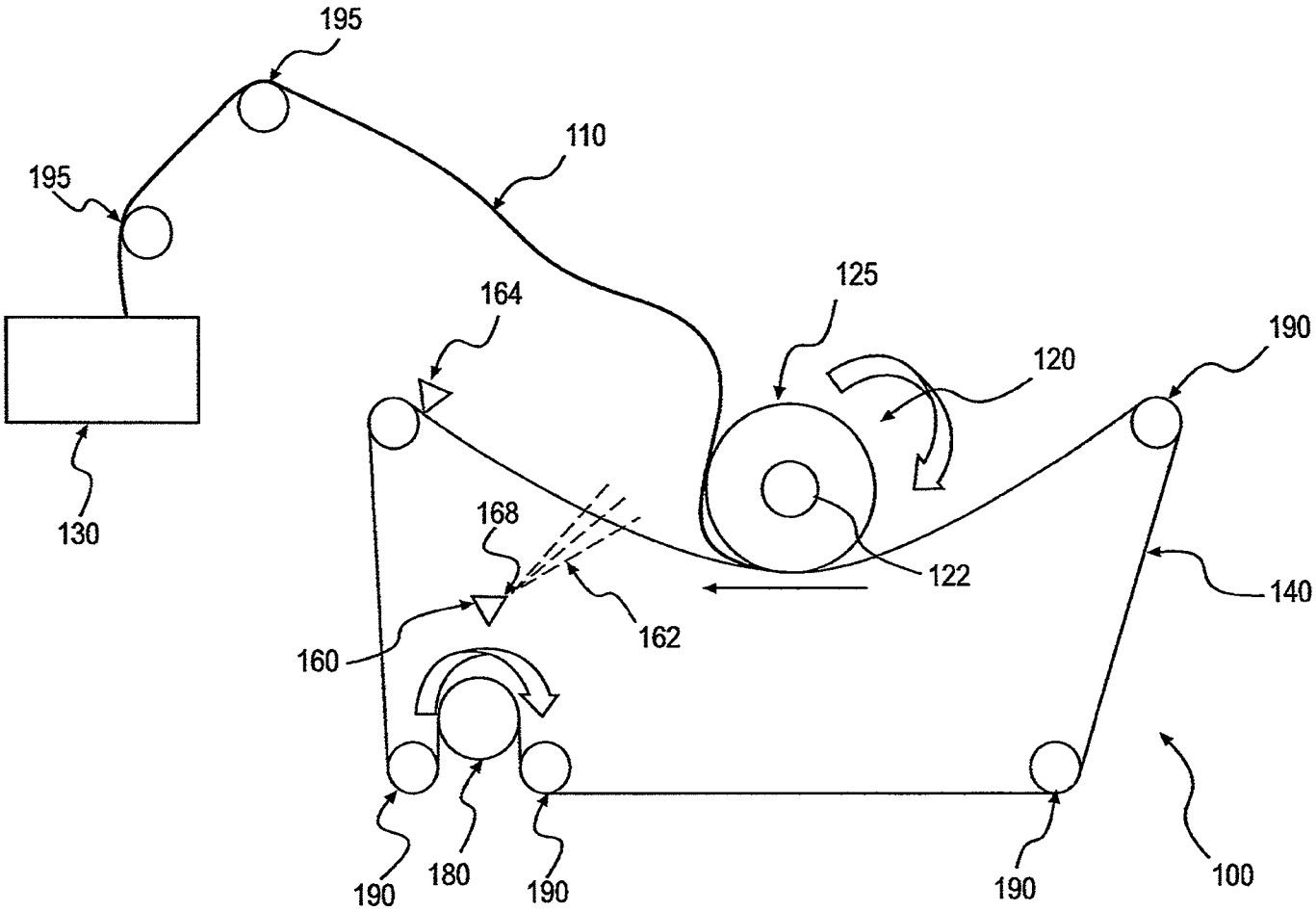
FIG. 3 is a side view of an exemplary embodiment of an unwind stand as disclosed herein.

As depicted in FIG. 3, the unwind stand 100 may be configured to unwind parent roll 120 from the bottom. During the unwind process, the drive system 180 may be activated and may cause the belt 140 to rotate about rollers 190. In one embodiment, drive system 180 may rotate in a clockwise direction, resulting in the counter-clockwise rotational movement of belt 140. The rotational movement of belt 140 may then impart a clockwise rotation to parent roll 120 due to the frictional forces between the belt 140 and the parent roll 120. In another embodiment, depicted in FIG. 11A, the rotational movement of shafts or rollers 901 may impart a rotation to parent roll 120 due to the frictional forces between the shafts or rollers 901 and the parent roll 120. In yet another embodiment, depicted in FIG. 11B, drive system 180 may be coupled to the parent roll 120 or the shaft of the parent roll 120 either directly or indirectly, for example, via a chain or belt 910.

In one aspect, parent roll 120 rotates in a direction that may cause the web 125 to unwind from the parent roll 120. In particular, a web tail 110 may be created by the unwinding of the parent roll 120. The web tail 110 may be processed into other products by additional downstream processing equipment, not shown. In one embodiment, the web tail 110 may be guided to the downstream equipment by tail rollers 195. In another embodiment, the web tail 110 may pass through a splicing area 130 before being processed by downstream equipment.

In another aspect, eventually the first parent roll 120 may unwind to a point where the web 125*a* (see FIG. 1) of a second parent roll 120*a* (see FIG. 1) is spliced into the process. Before this time, the second parent roll 120*a* may have been idle on unwind stand 100*a* (see FIG. 1). To start the splicing process the unwind stand 100*a* may begin to unwind parent roll 120*a* on unwind stand 100*a* which may allow the web tail 110*a* (see FIG. 1) to enter the splice area 130 and be spliced into the operation of the system. The splicing preferably occurs while the downstream process continues to operate.

After the splice, the web 125 may be cut and a web tail 110, also simply called a tail, may be created. In one embodiment, the web 125 may be cut while the parent roll 120 continues to rotate. For example, the web 125 may be cut while the parent roll 120 continues to rotate at a web speed substantially similar to the web speed at which the parent roll 120 rotates during the unwind process. In other embodiments, the parent roll 120 may speed up or slow down before the web 125 is cut. In other embodiments, the parent roll 120 is stopped prior to cutting the web 125. In some embodiments the acceleration or deceleration of the parent roll 120 may be sudden, occurring over the course of about 0 seconds to about 3 seconds, or more gradual, occurring over the course of about 3 seconds to about 15 seconds, about 5 seconds to about 30 seconds, or about 10 seconds to about 60 seconds. In other embodiments, the acceleration or deceleration may occur over any period of time that facilitates a change in speed of the parent roll 120. In some embodiments, the drive system 180 may continue to operate while the web 125 is cut, while in other embodiments the drive system 180 may be stopped while the web 125 is cut.

In a further aspect, in order to simplify the ejection of parent roll 120 from the unwind stand 100 and to reduce the probability of a long web tail 110 interfering with the ejection process, the web tail 110 may be rewound onto the parent roll 120 in a direction opposite to the first wound direction.

As depicted in FIG. 3, one or more of first nozzle 160 and second nozzle 164 may expel stream 162 such that the stream 162 impacts a portion of the tail 110 and causes at least a portion of the tail 110 to begin to move over the top of the parent roll 120. In some embodiments, one or more of the drive system 180, belts 140, and parent roll 120, may continue to move or rotate in the unwind direction while stream 162 impacts tail 110. In other embodiments, one or more of the drive system 180, belts 140, and parent roll 120 may be still or caused to rotate in a direction opposite to that of the unwind direction while stream 162 impacts tail 110.

In another aspect, nozzle 160 may expel a stream of fluid, such as water or tack adhesive, onto the web 125. By applying a fluid to the web 125 a first layer of the web 125 on the parent roll 120 may bond to a second or more layers of the web 125 on the parent roll 120. As the parent roll 120 continues to rotate, the bond between layers may cause the web tail 110 to wrap around the parent roll 120 in a direction opposite of the inner layers of parent roll 120 in a manner similar to that described below.

In still another aspect, a staple, punch, or crimp may be made in the outer web layers of the parent roll 120 to cause these layers to bond to each other. As the parent roll 120 continues to rotate, the bond between layers may cause the web tail 110 to wrap around the parent roll 120 in a direction opposite of the inner layers of parent roll 120 in a manner similar to that described below.

Figure 4:
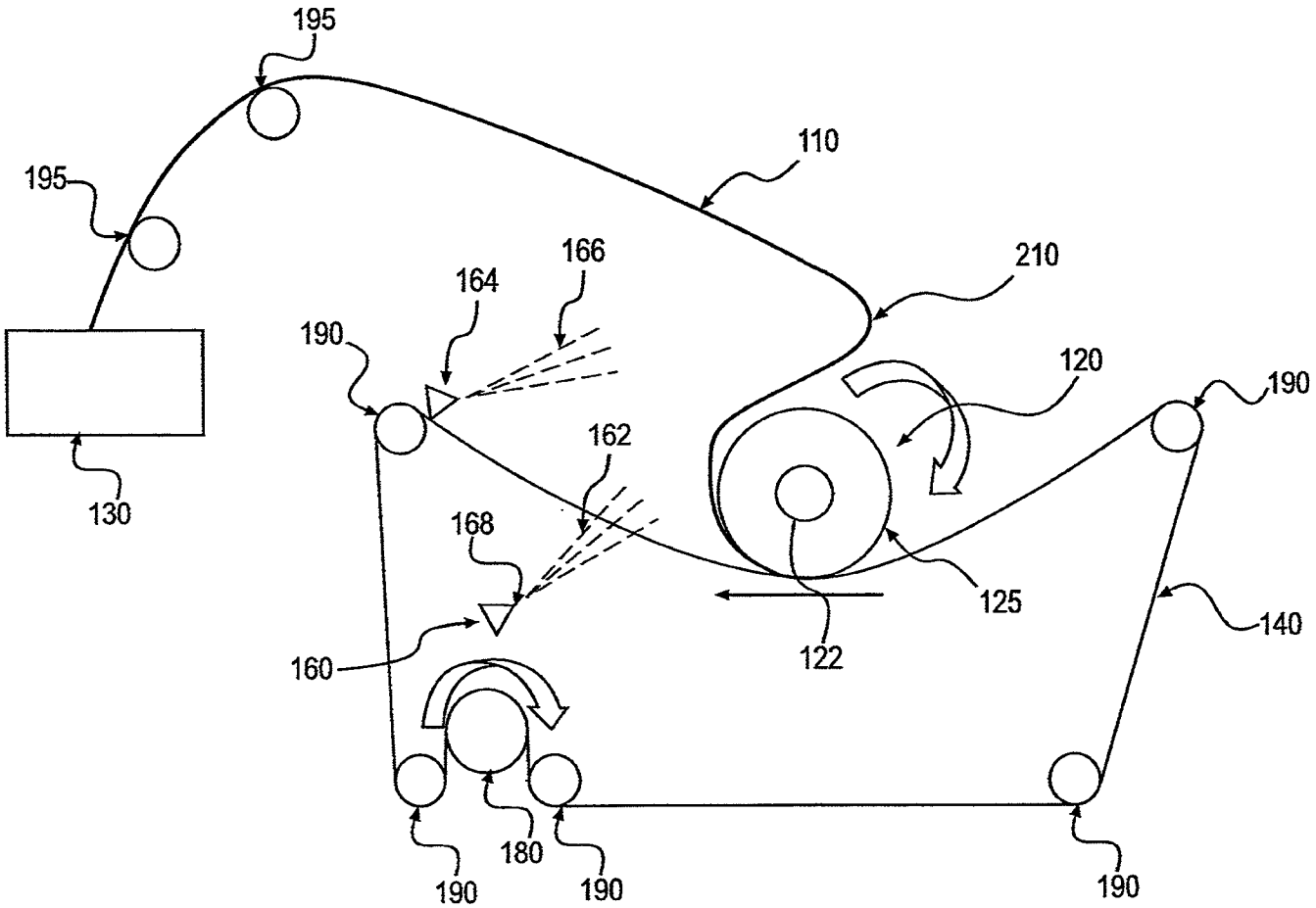
FIG. 4 is a side view of an exemplary embodiment of an unwind stand as disclosed herein.

In another aspect, depicted in FIG. 4, while one of nozzles 160 or 164 expels stream 162, another nozzle may begin expelling a second stream 166 such that the second stream 166 may impact a portion of the tail 110. Stream 166 may impact an area of the tail 110 that overlaps with the area of the tail stream 162 impacts, or it may impact an area of the tail 110 that is not substantially impacted by stream 162. In one embodiment, the streams 162 and 166 may lift the tail 110 over the top of the parent roll 120. In an embodiment with only one nozzle 160, such as, for example, shown in FIG. 9, the single nozzle 160 may operate such that a single stream 162 performs the same or similar function as the two nozzles 160 and 164 and two streams 162 and 166 of the embodiments depicted in FIGS. 3-7. In other embodiments more than two nozzles 160 may operate such that one or more streams perform the same or similar function as the two nozzles 160 and 164 and two streams 162 and 166 of the embodiments depicted in FIGS. 3-7. Indeed, anytime nozzle 160 and/or 164 are mentioned, one should understand that they may be replaced with one or more nozzles.

Further, while the second nozzle 164, for example, expels stream 166 in order to lift the tail 110 and push it over the top of the parent roll 120, the first nozzle 160 may shut off causing stream 162 to also shut off. In other embodiments, rather than shut off, stream 162 may be reduced. In other embodiments, one or both of nozzles 160 and 164 may move, rotate, or alter their respective streams at any time during the lifting of tail 110.

In one aspect, the lifting action may begin to cause a fold 210 in the web 125 to form while the parent roll 120 continues to rotate in the unwind direction. In another aspect, after fold 210 is created, both nozzles 160 and 164 may shut off and cease to expel air, or streams 162 and 166 may be reduced. In one embodiment, with no, or less, force from one or more streams to lift the tail 110, the tail 110 may fall onto the parent roll 120 which may continue to rotate in the unwind direction. In other embodiments, the position or direction of the nozzles 160 and/or 164 may change such that the tail 110 is directed onto, or may fall upon, the parent roll 120. In further embodiments, the duration, timing, sequencing, and intensity of nozzles 160 and 164 and streams 162 and 166 may be determined such that the streams 162 and 166 act to help prevent the tail 110 from falling back onto a portion of the unwind belts 140 between the parent roll 120 and the splicing area. Moreover, any or all of the action of the nozzles may be controlled by a controller such as, for example, the system 400 depicted in FIG. 2.

Figure 5:
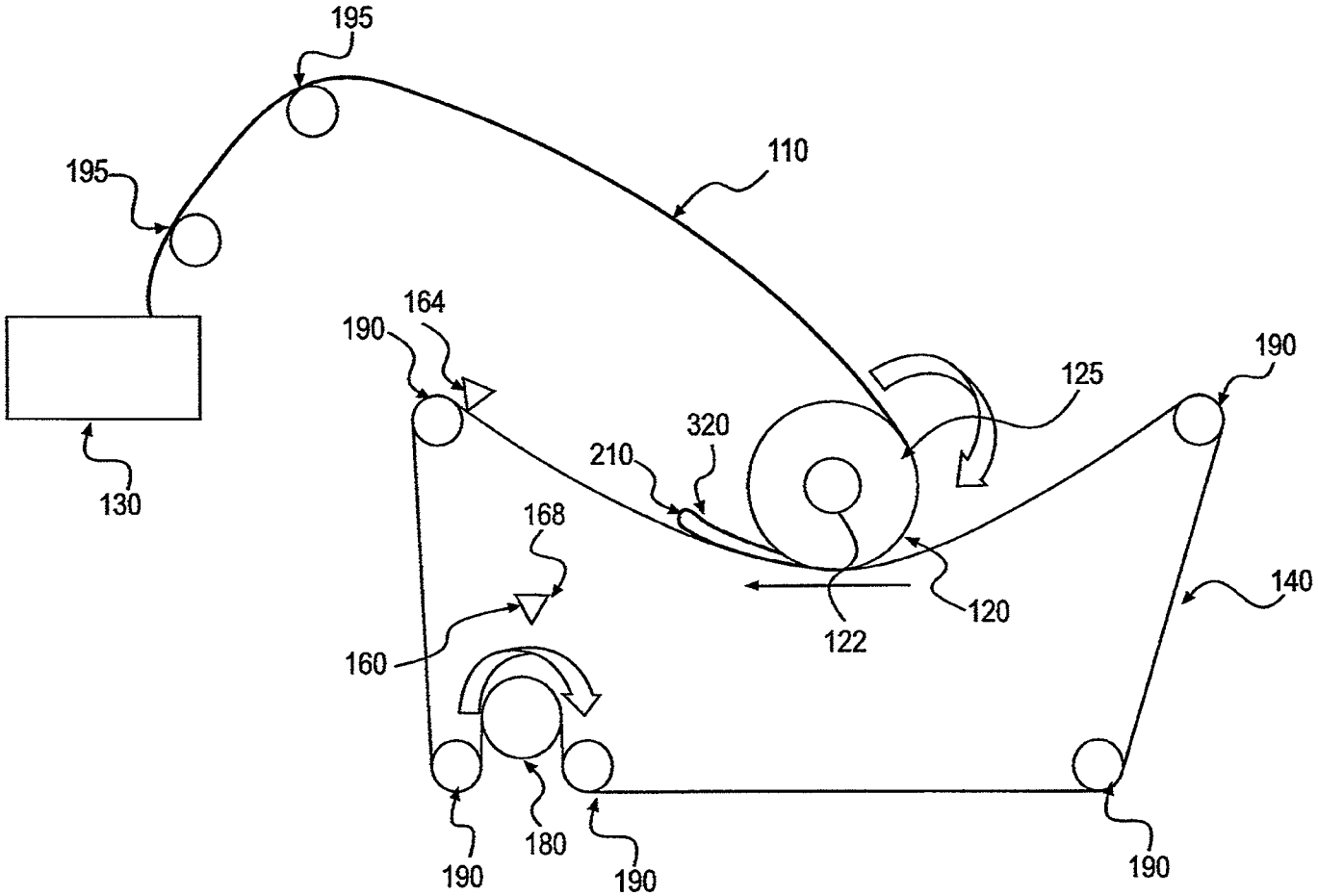
FIG. 5 is a side view of an exemplary embodiment of an unwind stand as disclosed herein.

In another aspect, as the parent roll 120 moves or rotates in the unwind direction, the fold 210 is captured between the bottom of the parent roll 120 and the belts 140 on a side of parent roll 120 opposite splicing area 130. Once captured, the fold 210 may pass around and underneath the parent roll 120 and a folded tail 320 may emerge at the side of the parent roll 120 facing the splicing area, as shown in FIG. 5. In some embodiments, the time required for the fold 210 to travel back around the parent roll 120 may be determined based on the diameter of the parent roll 120 and/or the rotational speed of parent roll 120. In another aspect, the rotational speed of parent roll 120 may be controlled by a controller such as, for example, the system 400 depicted in FIG. 2.

Figure 6:
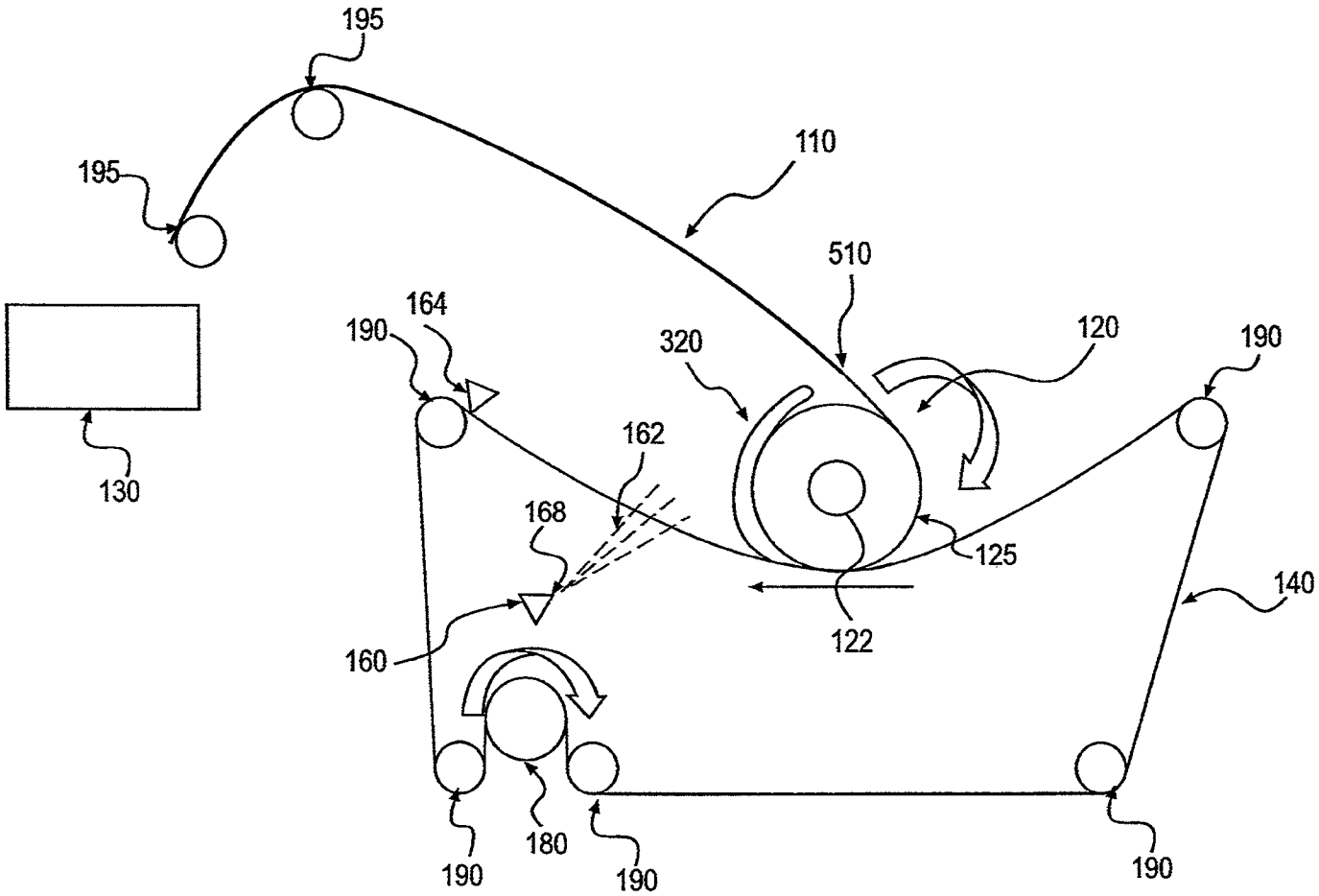
FIG. 6 is a side view of an exemplary embodiment of an unwind stand as disclosed herein.

In another aspect, one or more of first nozzle 160 and second nozzle 164 may expel stream 162 or 166 such that the stream(s) impacts a portion of the folded tail 320 and lifts the folded tail 320 upwards and away from belts 140. In one embodiment, the parent roll 120 may continue to rotate in the unwind direction which, in conjunction with the stream (s), may help pull the folded tail 320 into a nip 510 that may be formed between the parent roll 120 and the tail 110 as depicted in FIG. 6. In some embodiments, the nip 510 may pinch or otherwise capture the folded tail 320. In other embodiments, the amount of time that one or more of nozzles 160 and 164 expels stream 162 or 166 such that it impacts a portion of the folded tail 320 and lifts the folded tail 320 upwards and away from belts 140 may be dependent on the diameter of the parent roll 120 and may be controlled by a controller such as, for example, the system 400 depicted in FIG. 2. In other embodiments, the amount of time that one or more of nozzles 160 and 164 expels stream 162 or 166 such that it impacts a portion of the folded tail 320 and lifts the folded tail 320 upwards and away from belts 140 may be dependent on other factors known in the art. Similarly, the velocity of stream 162 or 166 and/or other features of the stream(s) may be manipulated to facilitate the upward lifting of folded tail 320.

Figure 7:
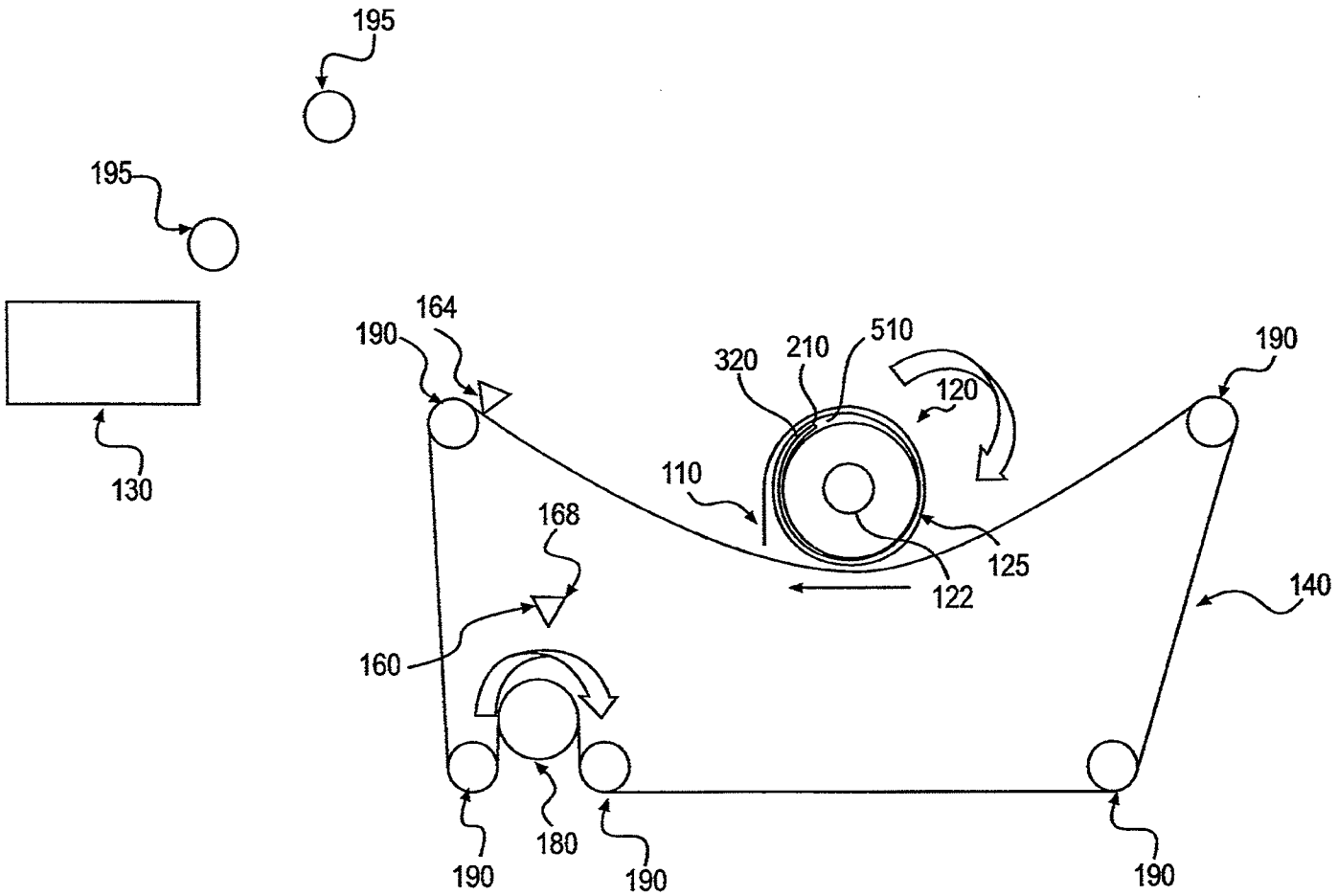
FIG. 7 is a side view of an exemplary embodiment of an unwind stand as disclosed herein.

In another aspect, once folded tail 320 has been pinched or captured in nip 510, the continued rotation of the drive system 180, belts 140, and/or parent roll 120 results in the rewinding of tail 110 about parent roll 120. In one embodiment, drive system 180, belts 140, and/or parent roll 120 continue to move or rotate in the unwind direction until the desired amount of tail 110 is rewound around the parent roll 120, as depicted in FIG. 7. For example, in some embodiments, substantially all of the tail 110 may be rewound. In other embodiments, more or less of tail 110 may be rewound. It should be noted, the outer layers of the web 125 wound about parent roll 120 comprising tail 110 may now be wound about parent roll 120 in an opposite direction compared to the inner layers (the portions of web 125 never unwound from parent roll 120) of the parent roll 120.

Figure 8A:
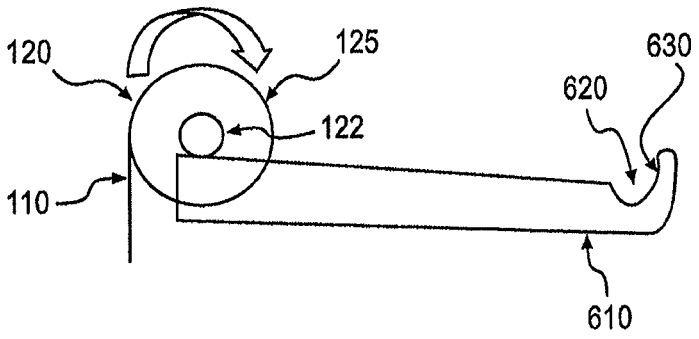
FIGS. 8A-C are side views of an exemplary embodiment of an ejection process as disclosed herein.
Figure 8B:
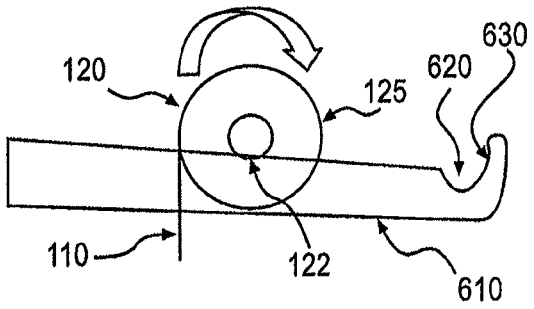
Figure 8C:
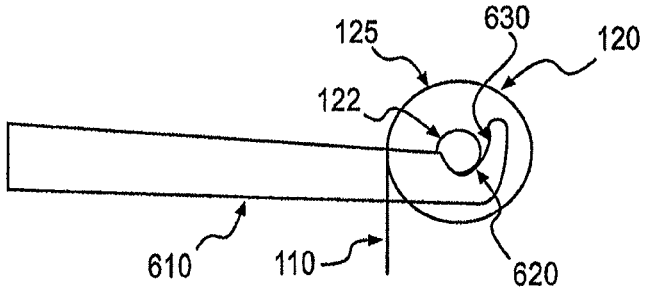

As depicted in FIGS. 8A-C, after the tail 110 has been rewound around parent roll 120, the roll may be ejected from the unwind stand 100 (FIG. 1) onto ejection arms 610. In one embodiment, the parent roll 120 is supported on the ejection arms 610 by parent roll shaft 122, as shown in FIG. 8A. In one embodiment, ejection arms 610 are elongate members oriented substantially perpendicular to an axis extending along parent roll 120 and/or shaft 122, and positioned on either end of parent roll 120. Ejection arms 610 may be of any suitable length so as to facilitate removal of parent roll 120 from unwind stand 100. Moreover, ejection arms 610 may be comprised of any material suitable to support parent roll 120. In alternative embodiments, ejection arms 610 may comprise one or more "ramp-like," planar surfaces, rather than the elongate members depicted in FIGS. 8A-C. In another aspect, ejection arms 610 may comprise a recess 620 at a distal end thereof, recess 620 being configured to mate with parent roll 120 and/or shaft 122. In one embodiment, ejection arms 610 further comprise an abutment surface 630 configured to prevent parent roll 120 from traveling beyond or out of recess 620.

In one aspect, the parent roll 120 may roll along the ejection arms 610 (FIG. 8B) until it comes to rest in recess 620 (FIG. 8C). While rolling along the ejection arms 610 (FIG. 8B), the parent roll 120 may rotate in the unwind direction, but because the tail 110 is wound around the parent roll 120 in an opposite direction, the rolling action of the parent roll 120 may help prevent the tail from lengthening.

Figure 10:
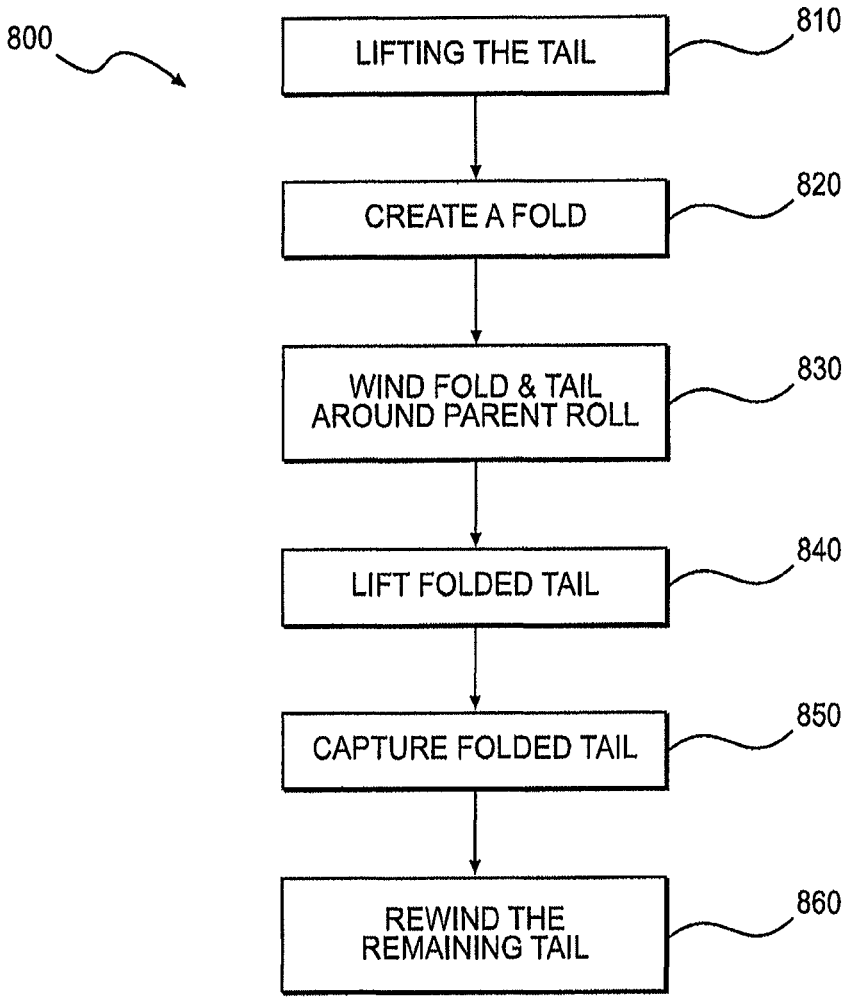
FIG. 10 is a flow chart depicting an exemplary embodiment of a method as disclosed herein.

FIG. 10 (with reference to FIGS. 6 and 7) depicts a flow chart 800 that describes a method for reducing the length of tail 110. In one aspect, at step 810, stream 162 lifts the tail upward and away from the belts 140. In some embodiments, after the tail 110 is lifted from the belts 140, at step 820, the stream may continue to act on tail 110 so as to create a fold in the tail between a portion of the tail immediately adjacent parent roll 120 and a portion of the tail extending from splicing area 130. In another aspect, the fold and the tail may then be wound around and underneath the parent roll 120 until the folded tail emerges from under the parent roll 120 at step 830. Next, at step 840, the stream 162 may lift the folded tail upwards and away from belts 140 and towards the parent roll 120. At step 850, the folded tail may then be pinched or captured in a nip created between the remaining tail extending from parent roll 120 and the outer circumference of parent roll 120. Subsequently, at step 860, the remaining tail may be rewound around the parent roll 120 such that the outer layers of the paper web on the parent roll 120 are wound in an opposite direction compared to the inner layers of the parent roll 120.

In accordance with another aspect of the invention the duration, intensity, direction, and sequencing of operation of one or more nozzles are determined based on at least the diameter of the parent roll and may be controlled by a controller such as, for example, the system 400 depicted in FIG. 2.

It should be noted that the methods and systems described herein should not be limited to the examples provided. Rather, the examples are only representative in nature.

Furthermore, while the above disclosure describes the use of paper web tail reduction, it should be understood that a web of any material may be used in conjunction with the methods and systems described herein. The disclosure is not limited to the reduction of paper web tails.

Additionally, other embodiments will be apparent from consideration of the specification and practice of the present disclosure. It is intended that the specification and examples be considered as exemplary only, with a true scope and spirit of the invention being indicated by the following claims.

What is claimed is:

1. A system for rewinding and reducing the length of a web tail, comprising:

a parent roll supported by an unwind stand, wherein the parent roll comprises a web wound in a first direction corresponding to the direction of rotation of the parent roll used to wind the web;

a web tail extending from the parent roll; and a first nozzle positioned below the web tail and configured to expel a gas or liquid directed at the location where the web tail separates from the parent roll such that the gas or liquid impacts at least a portion of the web tail to cause the portion of the web tail to begin to move over the top of the parent roll in a second direction opposite the first direction.

2. The system of claim 1, wherein the unwind stand comprises:

a drive system;

one or more rollers; and one or more belts in contact with a parent roll, wherein the belt is configured to impart a rotation to the parent roll.

3. The system of claim 2, wherein the unwind stand is further comprised of ejection arms that support the parent roll during ejection.

4. The system of claim 3, wherein the web tail is a paper web tail and the web is a paper web.

5. The system of claim 1, further comprising one or more tail rollers that support the web tail.

6. The system of claim 5, further comprising a splice area, wherein the tail rollers are configured to guide the web tail into the splice area.

7. The system of claim 1, further comprising a second nozzle, the first and second nozzles operable to expel a gas or liquid, creating a stream that impacts the web tail.

8. The system of claim 1, wherein the first nozzle is configured to expel the gas or liquid so as to rewind the web tail around the parent roll in the second direction.

* * * * *